US005290001A

United States Patent [19]

Jones

[11] Patent Number: 5,290,001

[45] Date of Patent: Mar. 1, 1994

[54] INTERLOCKING PLANT MOBILE

[76] Inventor: Spaulding E. Jones, 5555 Spring Valley Rd. #1037, Dallas, Tex. 75240

[21] Appl. No.: 883,480

[22] Filed: May 15, 1992

[51] Int. Cl.[5] ..... A01G 9/02

[52] U.S. Cl. ..... 248/318; 47/67

[58] Field of Search ..... 248/317, 318; 211/113; 47/67

[56] References Cited

U.S. PATENT DOCUMENTS

| | | | |
|---|---|---|---|
| 124,818 | 3/1972 | Hibbert | 47/67 |
| D. 188,205 | 6/1960 | Hogan | 47/67 |
| 941,448 | 11/1909 | Haglund | 248/318 |
| 2,067,528 | 1/1937 | Greene | 248/317 |
| 3,081,058 | 3/1963 | De Vries et al. | 248/318 |
| 4,065,090 | 12/1977 | Mauney | 248/318 |
| 4,149,339 | 4/1979 | Hall et al. | 47/67 |
| 4,170,089 | 10/1979 | Smrt | 47/67 |
| 4,170,843 | 10/1979 | Talwani | 47/39 |
| 4,189,124 | 2/1980 | Faris | 248/318 |
| 4,314,646 | 2/1982 | Purnell | 211/113 |
| 4,349,172 | 9/1982 | Banks, Jr. | 248/318 |
| 4,373,695 | 2/1983 | Faris | 248/318 |
| 4,506,475 | 3/1985 | Elliott | 47/67 |
| 4,524,542 | 6/1985 | Elliott | 47/67 |
| 4,592,166 | 6/1986 | Tendrup et al. | 47/67 |
| 4,658,540 | 4/1987 | Hougard | 47/67 |
| 4,691,473 | 9/1987 | Ragen | 47/67 |
| 4,779,377 | 10/1988 | Davis | 47/67 |
| 4,825,589 | 5/1989 | Straw et al. | 47/67 |
| 4,876,824 | 10/1989 | Newsfeder | 47/67 |

*Primary Examiner*—Scott Smith

*Attorney, Agent, or Firm*—Arnold White & Durkee

[57] ABSTRACT

This combination mobile sculpture and plant holder has two interlocking links. One link is suspended from the ceiling and the other link has a plant holder attached to it. Each link has an outer and an inner perimeter having a geometric shape. Corresponding slots on each of the links allow the links to be locked together. One of the links has a split to allow the links to be interlocked. The split extends from one of the slots to the opposite perimeter. The split makes several curves to form a mortise and a tenon to lock the two sides of the split together. The cooperating slot on the other link locks the split together when the links are locked together. An alternative to the mortise and tenon is a pair of inserts wedged between the first link and the slot on the inner perimeter of the second link.

11 Claims, 4 Drawing Sheets

INTERLOCKING PLANT MOBILE

BACKGROUND OF THE INVENTION

1. Field of the Invention

This invention relates in general to decorative plant holders, such as hanging baskets. In particular, the invention relates to mobile sculptures, suspended from a ceiling, for holding plants in places such as indoors, on patios, on balconies, or even outdoors.

2. Description of related art including information disclosed under 37 C.F.R. §§ 1.97–1.99

It has been popular for many years to place indoor plants in pots hung from the ceiling. Pots are often suspended by a rope tied to a hook attached to the ceiling or other suspensions indoors and outdoors. Many different sizes and types of rope, such as macrame, have been used for suspending pots.

In other cases, several metal wires are attached to the upper rim of the pot. The unsightly wires are then substantially hidden by the leaves of the plant.

Mobile sculptures have been a popular form of fine art for many years. A mobile is generally an arrangement of thin forms, rings, rods, etc. that are suspended from a ceiling by means of fine wires or threads. Simple geometric shapes, such as circles, ovals, and rectangles have also been used in mobile sculptures.

SUMMARY OF THE INVENTION

The general object of the invention is to combine mobile sculpture and hanging plants, by providing a mobile for holding a plant. In general, this object is accomplished by a mobile consisting of a pair of interlocking links. One link is suspended from the ceiling and the other link has a plant holder attached to it.

Each of the links has an outer perimeter and an inner perimeter, each perimeter being a specific geometric shape, such as a circle or rectangle. The links have cooperating slots to allow the two links to be locked together.

One of the links is split, so that the two links can be interlocked. The split extends from one of the slots to the opposite perimeter. Thus, the cooperating slot on the other link acts to hold the split together. The split curves to form a mortise and tenon, so that when the two links are locked together the two sides of the split are locked together.

The above, as well as additional objects, features, and advantages of the invention will become apparent in the following detailed description.

DESCRIPTION OF THE PREFERRED EMBODIMENT

Figure 1:
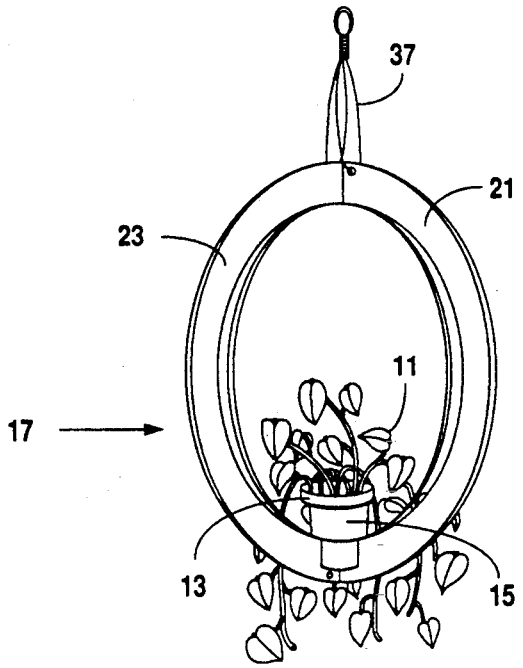
FIG. 1 is a left front elevation of an interlocking plant mobile according to the invention, holding a potted plant.
Figure 2:
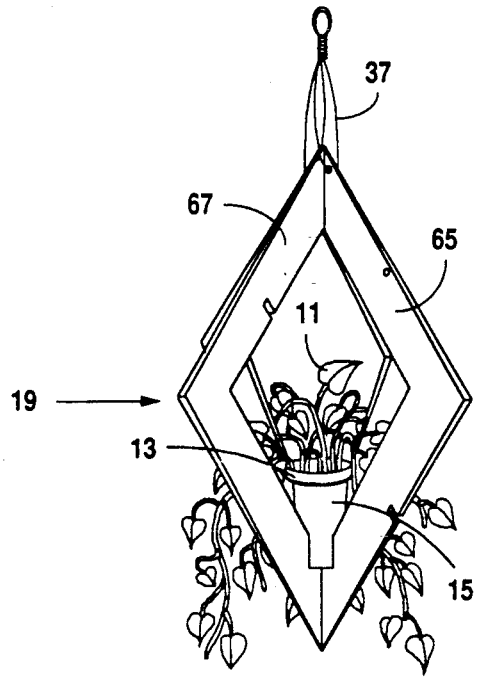
FIG. 2 is a left front elevation of an alternate embodiment of the interlocking plant mobile of the invention, holding a potted plant.

FIGS. 1 and 2 illustrate two possible embodiments of the invention. In each embodiment shown, a plant 11 is placed within a flower pot 13 and the pot 13 is placed within a holder 15. The holder 15 is attached to a mobile 17 or 19.

Figure 3:
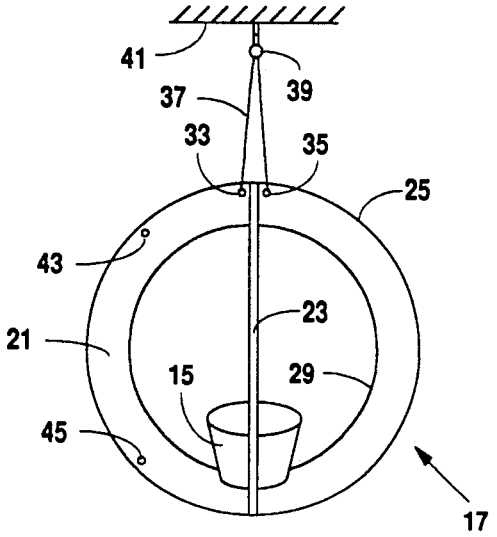
FIG. 3 is a front elevation of an interlocking plant mobile.
Figure 4:
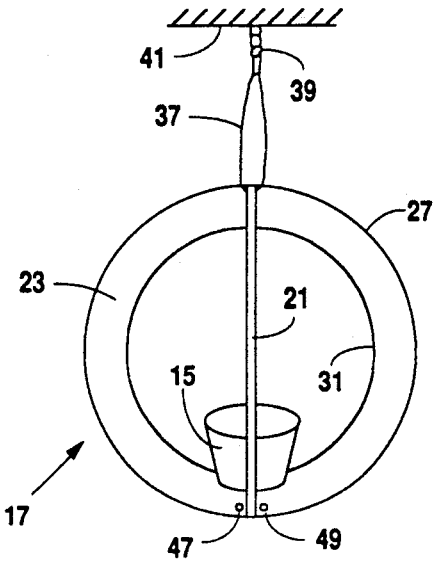
FIG. 4 is a side elevation of the interlocking plant mobile.
Figure 10:
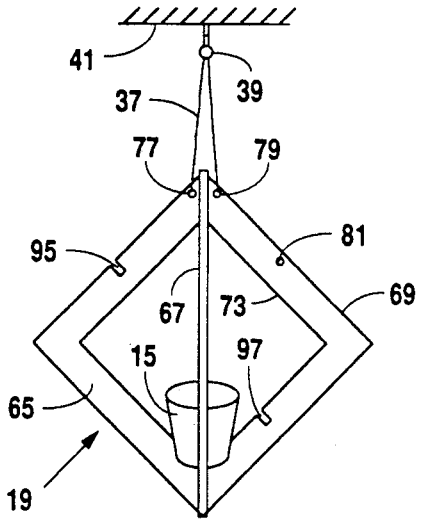
FIG. 10 is a front elevation of an alternate embodiment of the interlocking plant mobile of the invention.
Figure 11:
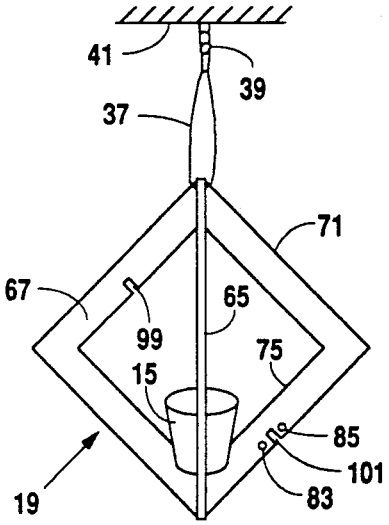
FIG. 11 is a side elevation of the alternate embodiment of the interlocking plant mobile.

The mobile 17 shown in FIGS. 1, 3, and 4 is one embodiment of the invention, and the mobile 19 shown in FIGS. 2, 10, and 11 is a second embodiment. Other embodiments are also possible, as will become apparent.

Figure 5:
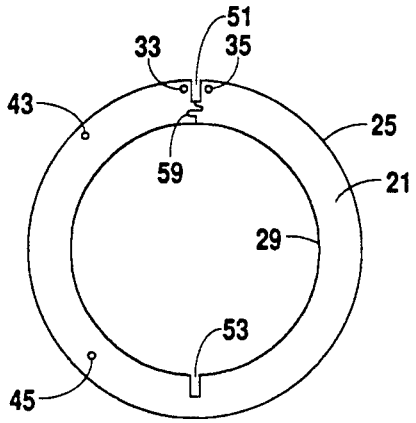
FIG. 5 is a front elevation of the first link of the interlocking plant mobile.
Figure 6:
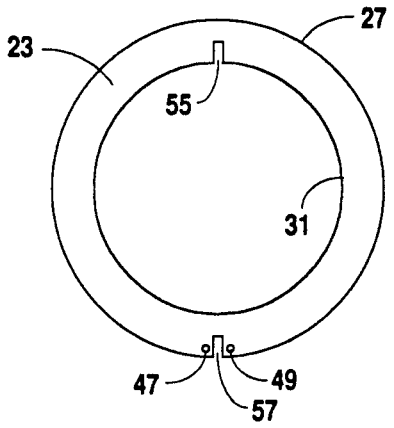
FIG. 6 is a front elevation of the second link of the interlocking plant mobile.

The first embodiment of the invention 17 has two links 21 and 23 that are shown singly in FIGS. 5 and 6, respectively. The links 21 and 23 may be made of metal, plastic, or some other strong, light-weight material.

Each of the links 21 and 23 has a circular outer perimeter 25 and 27 and a concentric circular inner perimeter 29 and 31. Each link 21 and 23 is thus a round or circular ring. The preferred size of the links 21 and 23 depends upon the size of the plant 11 to be held, but a typical link 21 and 23 may have a diameter of about eighteen inches and a thickness of about one eighth inch.

The first link 21 has a pair of eyelets 33 and 35 near the top of the link 21. These eyelets 33 and 35 receive a hanger 37, such as a wire, a cord, or a chain, with which the mobile 17 is suspended from a hook 39. The hook 39 is attached to the ceiling 41 or other support.

The first link 21 may also have other alternate eyelets 43 and 45 at other locations around its circumference. These alternate eyelets 43 and 45 allow the mobile 17 to be suspended at different angles. The second link 23 may also have alternate eyelets 47 and 49, to provide a place for a second mobile to be suspended below the first 17.

Figure 7:
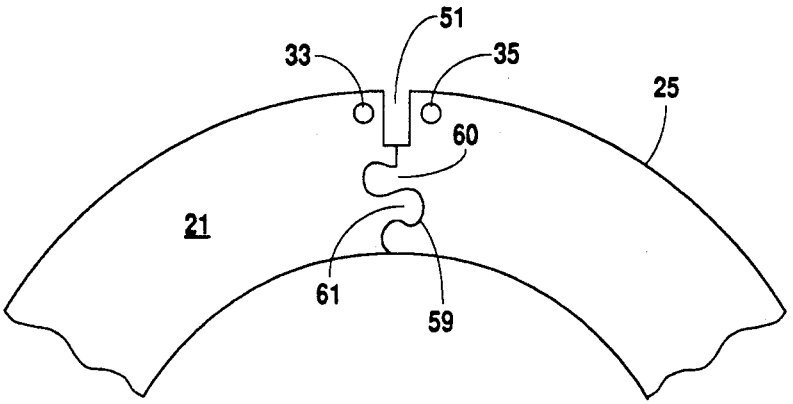
FIG. 7 is a close-up view of a portion of the first link shown is in FIG. 5.

The first link 21 has a pair of slots 51 and 53, as seen in FIGS. 5 and 7. One slot 51 is at the top of the first link 21 and is on the outer perimeter 25. The other slot 53 is at the bottom of the link 21 and is on the inner perimeter 29.

The second link 23 also has a pair of slots 55 and 57, as seen in FIG. 6. One slot 55 is at the top of the second link 23 and in on the inner perimeter 31. The other slot 57 is at the bottom of the link 23 and is on the outer perimeter 27. The upper slots 51 and 55 cooperate and the lower slots 53 and 57 cooperate to allow the two links 21 and 23 to be locked together to form the round mobile 17, as seen in FIGS. 1, 3, and 4.

The first link 21 has a split 59 that allows the two links 21 and 23 to be interlocked together. The split 59, shown in detail in FIG. 7, is located between the bottom of the upper slot 51 and the inner perimeter 29 of the first link 21. Preferably, the split 59 curves several times between the slot 51 and the inner perimeter 29 to form a mortise 60 and a tenon 61. The split 59 could also have other shapes, such as a dovetail.

The mortise 60 and tenon 61 hold the split 59 together, much as a pair of jigsaw pieces are held together by their shapes. When the two links 21 and 23 are connected, the upper slot 55 of the second link 23 holds the two side of the split 59 together.

Figure 8:
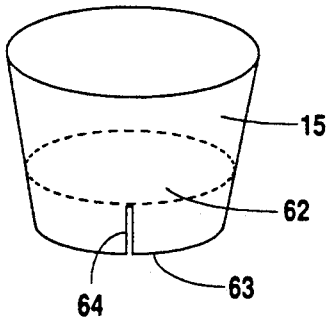
FIG. 8 is a front perspective view of a pot holder of the invention.
Figure 9:
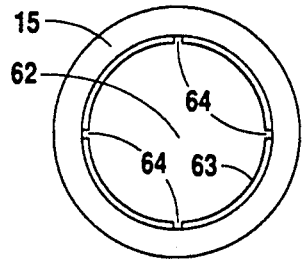
FIG. 9 is a bottom plan view of the pot holder.

The flower pot holder 15 is illustrated in detail in FIGS. 8 and 9. The holder 15 has a frusto-conical shape that tapers from top to bottom. The taper is generally equal to the taper on a typical flower pot 13, so that the pot 13 will fit snugly within the holder 15.

The bottom 62 of the holder 15 is recessed, as shown in FIG. 8, above the lower edge 63 of the holder 15. Four evenly spaced slots 64 extend from the lower edge 63 of the holder 15 upward to the bottom 62 of the holder 15. The holder 15 is placed on the mobile 17 so the links 21 and 23 fit in the slots 64 of the holder 15. The links 21 and 23 thus support the holder 15 and the holder stabilizes the mobile 17 by holding the links 21 and 23 in place.

A second holder 15 can be used to support the mobile 17 on a supporting surface, such as a table top. The second holder 15 is turned upside down and paced on the table. The mobile 17 is then placed so the links 21 and 23 fit in the slots 64 of the holder 15. When the second holder 15 supports the mobile 17 on a table, there is no need to use a hanger 37 or a hook 39.

The mobile 17 is assembled by first spreading the split 59 in the first link 21. The second link 23 is then placed within the first link 21, so that the links 21 and 23 are interlocked. The links 21 and 23 are then positioned perpendicular to one another, and locked together. The slots 51 and 53 on the first link 21 cooperate with the slots 55 and 57 on the second link 23. The links 21 and 23 thus form a round mobile 17, as seen in FIGS. 1, 3, and 4. A holder 15 is then placed on the links 21 and 23, and a flower pot 13 is placed within the holder 15. The completed mobile 17 can then be suspended by a hanger 37, such as a wire, a cord, or a chain, from a hook 39 in the ceiling 41 or other support.

Another embodiment of the invention is illustrated in FIGS. 2, 10, and 11. The basic difference is the shape of the links 65 and 67. In this embodiment, the links 65 and 67 are square, rather than circular. The pot 13, the holder 15, the hanger 37, the hook 39, and the ceiling 41 are the same as in the first embodiment.

Each of the link 65 and 67 has an outer perimeter 69 and 71, and an inner perimeter 73 and 75 that are square. Each link 65 and 67 is thus a square ring. The preferred size of the links 65 and 67 depends upon the size of the plant 11 to be held, but a typical link 65 and 67 may have a diagonal of about eighteen inches and a thickness of about one eighth inch.

The first link 65 has a pair of eyelets 77 and 79 near the top of the link 65. These eyelets 77 and 79 receive a hanger 37, such as a wire, a cord, or a chain, with which the mobile 19 is suspended from a hook 39. The hook 39 is attached to the ceiling 41 or other support.

The first link 65 may also have other alternate eyelets 81 at other locations around its circumference. These alternate eyelets 81 allow the mobile 19 to be suspended at different angles. The second link 67 may also have alternate eyelets 83 and 85, to allow the mobile 19 to be suspended at different angles.

Figure 12:
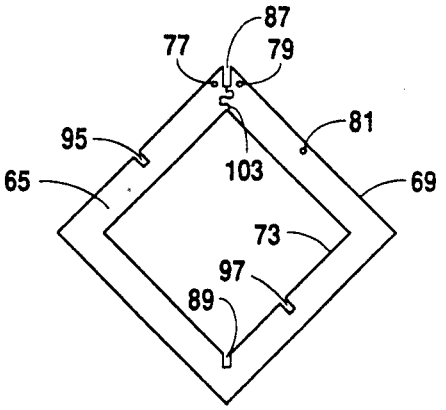
FIG. 12 is a front elevation of the first link of the alternate embodiment of the interlocking plant mobile.

The first link 65 has a pair of slots 87 and 89, as seen in FIG. 12. One slot 87 is at the top of the first link 65 and is on the outer perimeter 69. The other slot 89 is at the bottom of the link 65 and is on the inner perimeter 73.

Figure 13:
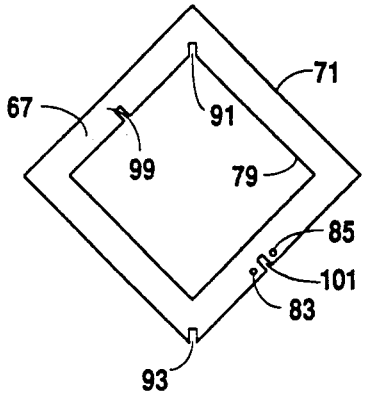
FIG. 13 is a front elevation of the second link of the alternate embodiment of the interlocking plant mobile.

The second link 67 also has a pair of slots 91 and 93, as seen in FIG. 13. One slot 91 is at the top of the second link 67 and in on the inner perimeter 75. The other slot 93 is at the bottom of the link 67 and is on the outer perimeter 71. The upper slots 87 and 91 cooperate and the lower slots 89 and 93 cooperate to allow the two links 65 and 67 to be locked together to form the square mobile 19, as seen in FIGS. 2, 10, and 11.

The links 65 and 67 may also have alternate slots, so that the links 65 and 67 can be put together in different ways. For example, the first link 65 may have a slot 95 on its outer perimeter 69 and a slot 97 on its inner perimeter 73. The second link 67 may have corresponding slots 99 and 101. By using these alternate slots 95, 97, 99, and 101, the mobile 19 has a square shape, rather than the diamond shape shown in the figures.

The first link 65 has a split 103 so that the two links 65 and 67 can be linked together. The split 103, shown in FIG. 12, is located between the bottom of the upper slot 87 and the inner perimeter 73 of the first link 65. Preferably, the split 103 makes several curves between the slot 87 and the inner perimeter 73 to form a mortise and a tenon. The split 103 could also have other shapes, such as a dovetail.

The mortise and tenon hold the split 103 together, much as a pair of jigsaw pieces are held together by their shapes. When the two links 65 and 67 are connected, the upper slot 91 of the second link 67 holds the two side of the split 103 together.

Figure 14:
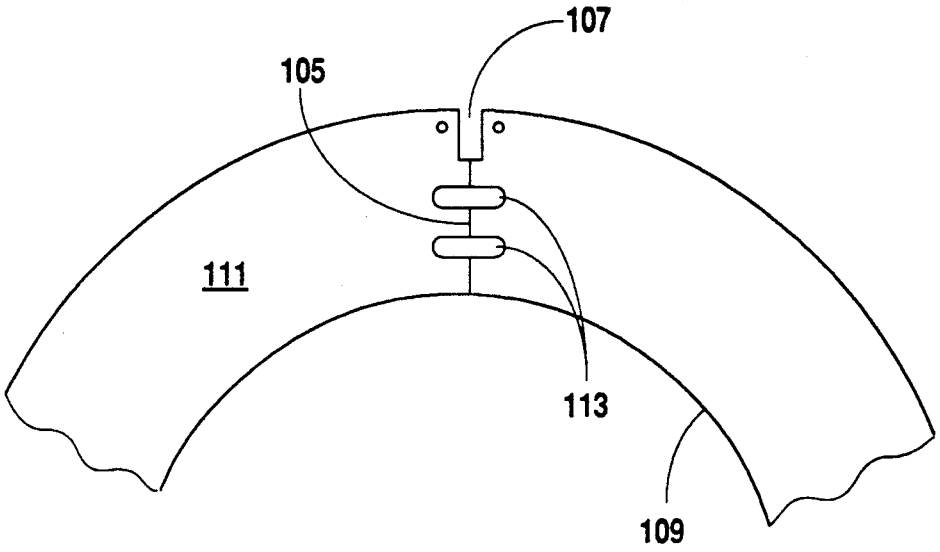
FIG. 14 is a close-up view of a portion of an alternate embodiment of the first link.

FIG. 14 shows an alternate method of holding the two sides of the split 105 together. In this embodiment, the split 105 is cut straight across from the slot 107 to the inner perimeter 109 of the first link 111. A pair of inserts 113 are then wedged between the first link 111 and the slot on the inner perimeter of the second link. The friction fit between the two links is sufficient to secure the two sides of the split 105 together.

The invention has several advantages over the prior art. The invention provides an artistic, and practical device for hanging plants. Before assembly, the links of the invention can be manufactured separately, and then stored flat. The holders can be nested in order to take up a minimum amount of space. The links can then be assembled without having to cut one and then repair the cut.

Also, the links can be put together in several different ways and the assembled mobiles can be hung in different ways, providing versatility for creativity. For example, in addition to the assembly shown in the drawings, the links can be assembled by placing slot 55 of the second link 23 into slot 53 of the first link 21. This creates a mobile consisting of two circles, one above the other, and at right angles to one another. The individual links can also be used alone, since each link can hold a plant holder.

The invention has been described in only a few embodiments. It should be apparent to those skilled in the art that the invention is not so limited, but is susceptible to various changes and modifications without departing from the spirit of the invention. For example, the shapes of the two interlocking pieces could be of other shapes, such as triangles, ovals, and other polygons. Also, a second holder 15 can be used to support the mobile 17 on a supporting surface, such as a table top.

I claim:

1. A plant holder, comprising:

first and second links;

the first link having an outer perimeter and an inner perimeter, each perimeter having a slot, the first link further including a split to allow interlocking of the first and second links;

the second link having an outer perimeter and an inner perimeter, each perimeter having a slot, the slots of the first and second links cooperating to allow the second link to be interlocked with the first link; and a pot holder, attached to the second link, for holding a pot in which a plant can be placed.

2. A plant holder, as recited in claim 1, wherein the split extends from the slot on the outer perimeter of the first link to the inner perimeter of the first link.

3. A plant holder, as recited in claim 2, wherein the slot on the inner perimeter of the second link holds the split on the first link together.

4. A plant holder, as recited in claim 3, wherein the split curves to form a mortise and a tenon.

5. A plant holder, as recited in claim 3, further comprising an insert wedged between the first link and the slot on the inner perimeter of the second link.

6. A plant holder, as recited in claim 1, wherein each link is substantially circular.

7. A plant holder, as recited in claim 1, further comprising a hanger for hanging the first link from a ceiling.

8. A plant holder, comprising:

first and second links;

the first link having a substantially polygonal outer perimeter and a substantially polygonal inner perimeter, each perimeter having a slot, the first link further including a split to allow interlocking of the first and second links;

the second link having a substantially polygonal outer perimeter and a substantially polygonal inner perimeter, each perimeter having a slot, the slots of the first and second links cooperating to allow the second link to be interlocked with the first link; and a pot holder, attached to the second link, for holding a pot in which a plant can be placed.

9. A plant holder, as recited in claim 8, wherein the split extends for the slot on the outer perimeter of the first link to the inner perimeter of the first link.

10. A plant holder, as recited in claim 9, wherein the slot on the inner perimeter of the second link holds the split on the first link together.

11. A plant hanger, as recited in claim 8, further comprising a hanger for hanging the first link from a ceiling.

* * * * *